US005158450A

United States Patent [19]

Horita et al.

[11] Patent Number: 5,158,450

[45] Date of Patent: Oct. 27, 1992

[54] BUCKLE ASSEMBLY

[75] Inventors: Yoshiyuki Horita, Toyama; Shunji Akashi, Kurobe, both of Japan

[73] Assignee: Yoshida Kogyo K.K., Tokyo, Japan

[21] Appl. No.: 773,447

[22] Filed: Oct. 9, 1991

[30] Foreign Application Priority Data

Oct. 11, 1990 [JP] Japan ..... 2-272957

[51] Int. Cl.[5] ..... A44B 11/00

[52] U.S. Cl. ..... 24/68 R; 24/68 E; 24/71.2; 24/163 R; 297/478

[58] Field of Search ..... 24/68 R, 68 E, 68 CD, 24/71.2, 194, 163 R, 594, 595, 596; 297/478, 468, 380

[56] References Cited

U.S. PATENT DOCUMENTS

| | | | |
|---|---|---|---|
| Re. 26,584 | 5/1969 | Spence . | |
| 1,622,954 | 3/1927 | Macheroux | 24/163 R |
| 1,744,501 | 1/1930 | Reichel et al. . | |
| 1,817,475 | 8/1931 | Becker . | |
| 2,794,226 | 6/1957 | Legat . | |
| 3,248,148 | 4/1966 | Board et al. | 24/194 |
| 3,341,250 | 9/1967 | Rasmussen | 297/478 |
| 3,375,994 | 4/1968 | Wohlert et al. | 297/478 |
| 3,826,473 | 7/1974 | Huber | 24/71.2 |
| 4,208,770 | 6/1980 | Takada | 24/194 |
| 4,570,305 | 2/1986 | Smetz et al. | 24/68 R |

FOREIGN PATENT DOCUMENTS

| | | | |
|---|---|---|---|
| 427846 | 8/1911 | France . | |
| 2602124 | 2/1988 | France | 24/16.3 R |
| 478463 | 2/1953 | Italy | 24/194 |
| 49-37117 | 4/1974 | Japan . | |

*Primary Examiner*—Victor N. Sakran

*Attorney, Agent, or Firm*—Hill, Van Santen, Steadman & Simpson

[57] ABSTRACT

A buckle assembly is disclosed for use in fastening opposite ends of a strap, belt, suspender and the like, which buckle assembly comprises a plug member, a socket member engageable therewith and a tension control means adapted to reciprocate the plug member back and forth through the socket member for a predetermined distance in response to tensile forces applied to the straps. A tension adjusting means is further provided to adjust the compressive tension of the tension control means to a desired extent.

13 Claims, 8 Drawing Sheets

BUCKLE ASSEMBLY

BACKGROUND OF THE INVENTION

1. Field of the Invention

This invention relates to a buckle assembly having a plug and a socket member for connecting respective opposite ends of straps, belts, suspenders and the like. More particularly, the invention is directed to such a buckle assembly which is capable of automatic adjustment of the effective length of a strap-like garment article.

2. Prior Art

There are known a variety of buckles, a typical example of which comprises a plug member and a socket member releasably engageable therewith. The socket member includes a strap-engaging end bar and a cross bar defining therebetween an opening through which a strap or belt is passed around the cross bar and underneath the end bar thus holding the strap in place by friction. While this type of buckle is simple in construction and useful where the strap or belt is subjected to only mild stresses, the strap is liable to loosening up when exposed to severe tensile force exerted as when the wearer is in sports activity. It would therefore become necessary to re-adjust the effective length of the strap every so often by loosening up and then pulling its tip end back to tighten the strap. Since the strap is held by friction, it is quite cumbersome to loosen up or pull for adjustment as the occasion calls for.

SUMMARY OF THE INVENTION

With the foregoing difficulties of the prior art in view, the present invention seeks to provide a buckle assembly which is capable of automatically adjusting the effective length of a strap or belt in response to the magnitude of a tensile force being exerted on the article.

The invention also seeks to provide a buckle assembly of the character referred to above which further incorporates means of controlling the tension with which a strap or belt is put to use.

The above and other objects, advantages and features of the invention will appear clear from the following detailed description taken in conjunction with the accompanying drawings.

According to one feature of the invention there is provided a buckle assembly for connecting respective ends of straps, belts, suspenders and the like which comprises: a plug member having an engaging tongue and an elongate opening for receiving one end of a strap; a socket member engageable with the plug member and having an elongate opening for receiving the opposite end of the strap; and a tension control means accommodated in the socket member and comprising a swivel disc rotatably supported in the socket member, a tensioning means operatively connected to the swivel disc for normally biasing the plug member toward the socket member and a tension transmission means connected between the plug member and the swivel disc and adapted to transmit tensile forces to and from the strap.

According to another features of the invention, the buckle assembly further includes a tension adjusting means which comprises a rotating member disposed coaxially with the swivel disc, connected to the tensioning means for adjusting the compressive tension of the latter and having a plurality of radially extending splines and a stopper member engageable with the splines to hold the rotating member against rotative movement

DETAILED DESCRIPTION OF THE INVENTION

Figure 1:
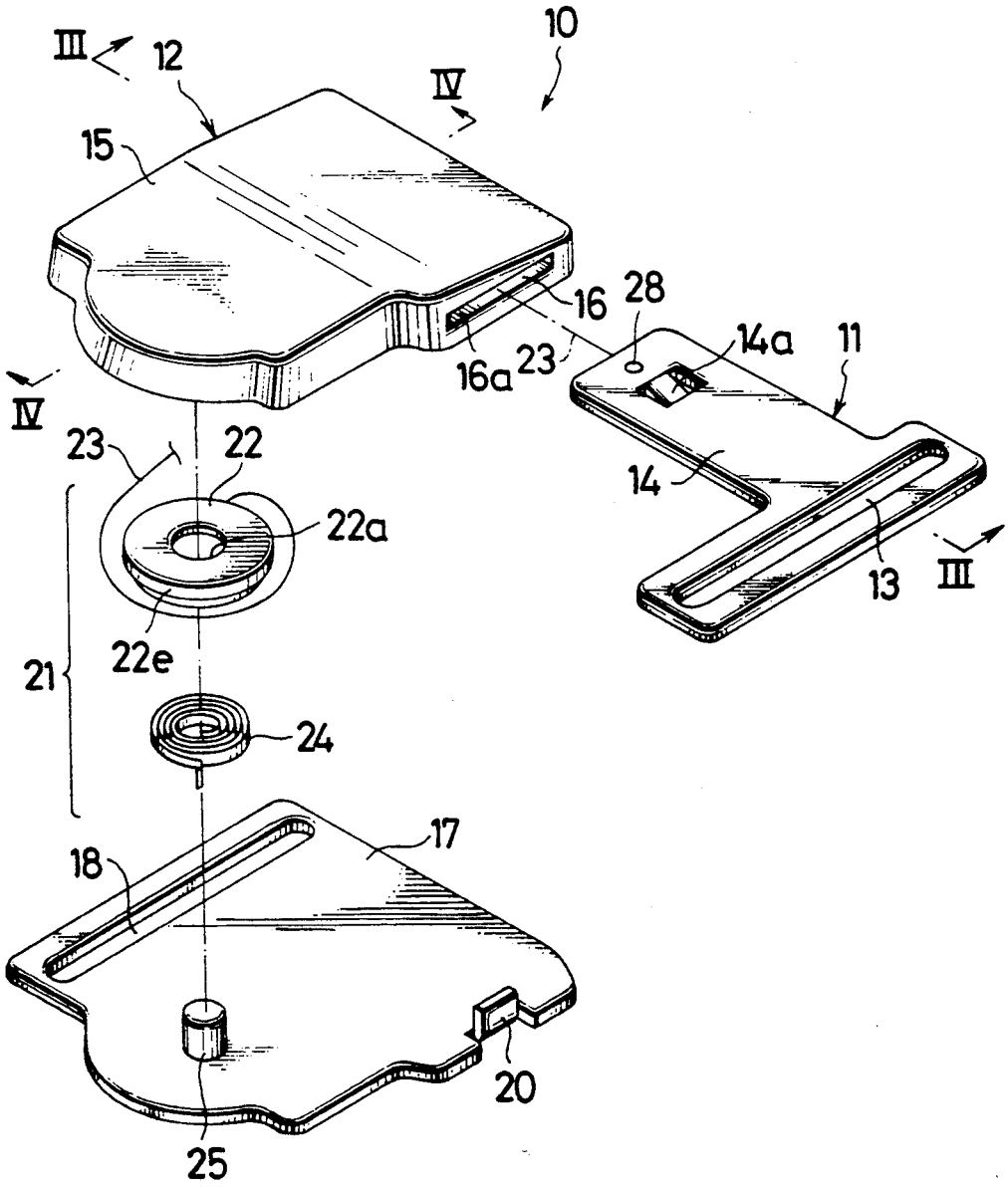
FIG. 1 is an exploded perspective view of a buckle assembly constructed in accordance with a preferred embodiment of the invention.
Figure 2:
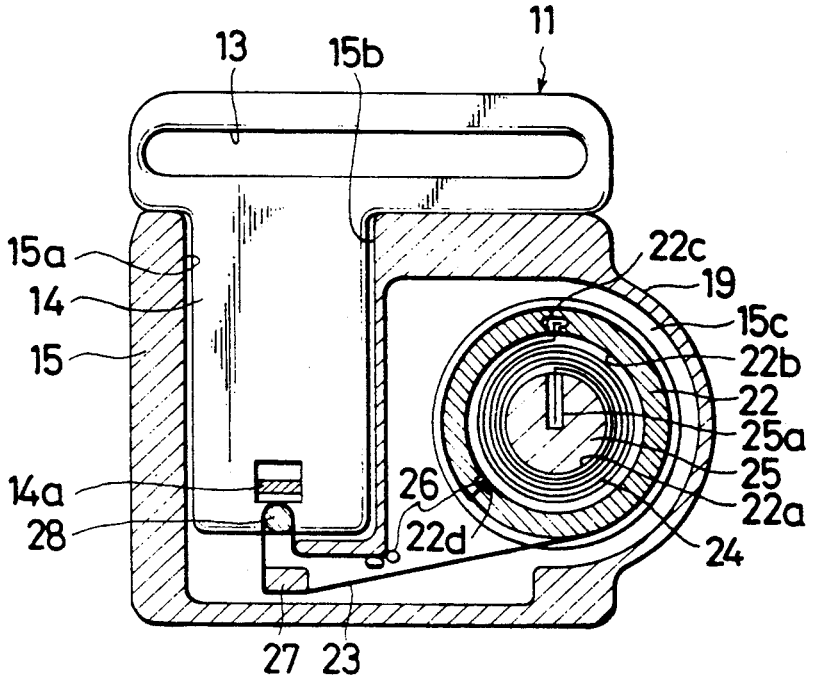
FIG. 2 is a partly sectional plan view of the buckle assembly.
Figure 3:
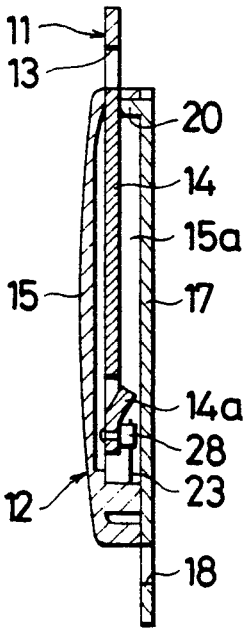
FIG. 3 is a longitudinal cross-sectional view taken on the line III—III of FIG. 1.
Figure 4:
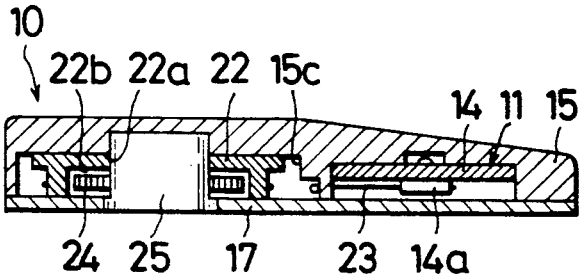
FIG. 4 is a transverse cross-sectional view taken on the like IV—IV of FIG. 1.
Figure 5:
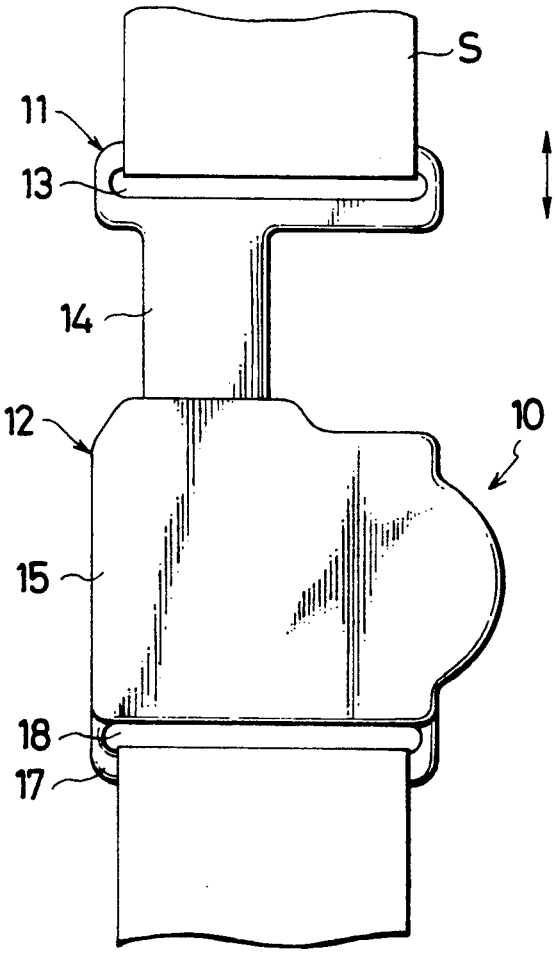
FIG. 5 is a plan view of the buckle assembly shown applied to a strap.
Figure 6:
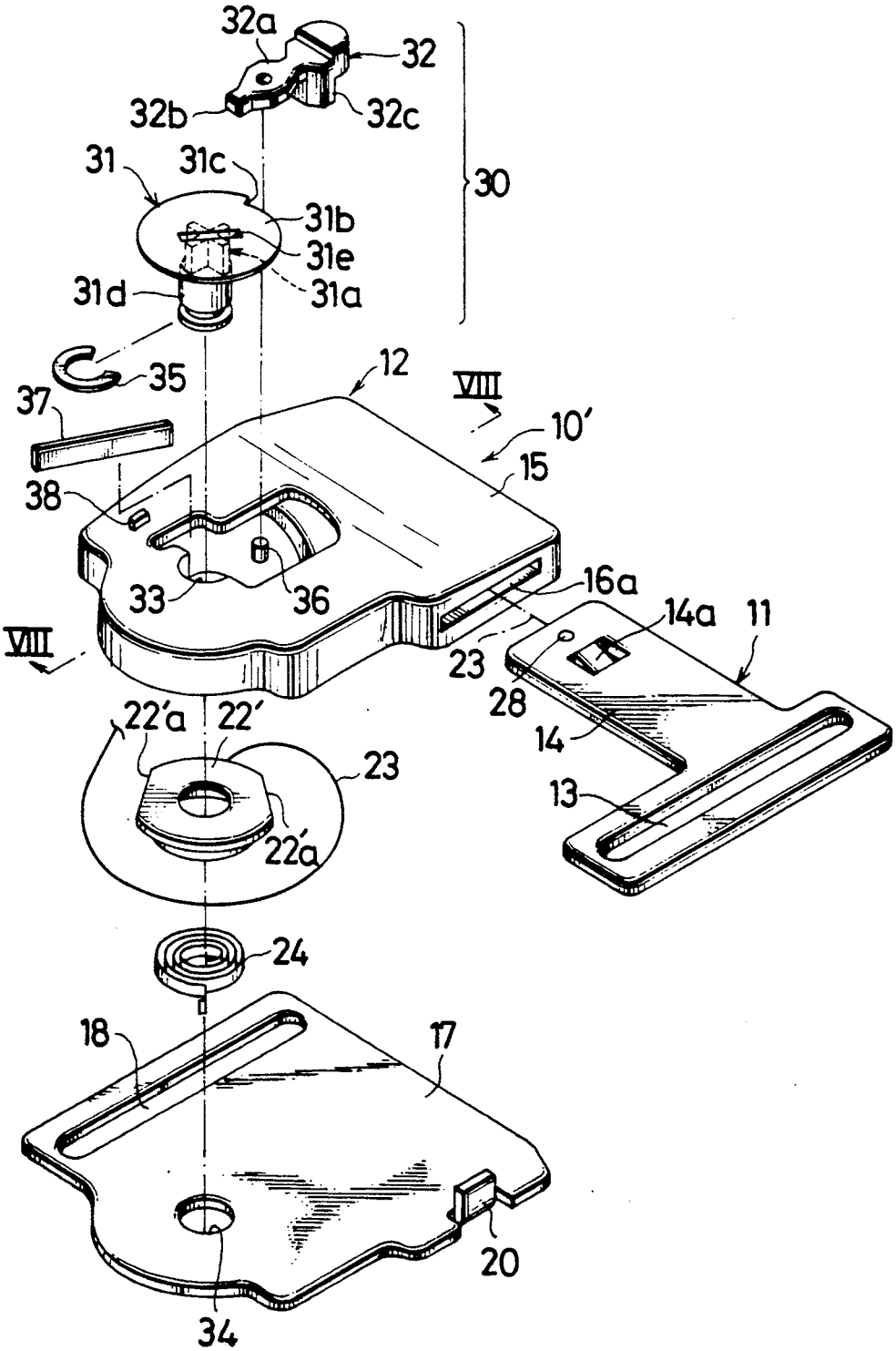
FIG. 6 is an exploded perspective view of a buckle assembly constructed in accordance with another preferred embodiment of the invention.

Referring now to the drawings and FIG. 1 in particular, there is shown a buckle assembly generally designated at 10 provided according to a preferred embodiment of the invention, the buckle assembly 10 comprising a plug member 11 and a socket member 12 releasably engageable therewith. The plug member 11 has an elongate opening 13 for receiving and anchoring one tip end of a strap S (FIG. 5) and an engaging tongue 14 extending parallel to a direction in which the strap S is connected to the buckle assembly 10. The socket member 12 includes a casing 15 generally rectangular in shape having a guide channel 16 dimensioned to receive the engaging tongue 14 of the plug member 11 and a base 17 having an elongate opening 18 at one of its ends for receiving and anchoring the opposite tip end of the strap S. The guide channel 16 is defined by confronting inner longitudinal walls **15*a* and 15*b* as shown in FIG. 2. The casing 15 and the base 17 are connected together by conventional means not shown, in which instance the opening 18 in the base 17 is exposed to view and disposed symmetrically to the opening 13 in the plug member 11 when the socket 12 and the plug 11 are joined together as better shown in FIG. 2**.

The socket member 12 has an arcuate bulged portion 19 to provide a chamber **15*c* large enough to accommodate a tension control means (later described) in the casing 15**.

The base 17 has a limiter lug 20 extending vertically adjacent to an open end **16*a* of the guide channel 16 and engageable in abutting relation with a downward projection 14*a* formed on the tongue 14 so as to limit a departing movement of the plug member 11 away from the socket member 12** when the strap S is pulled.

Designated at 21 is a tension control means which comprises a swivel disc 22, a tension transmission means 23 in the form of an actuating rope and a tensioning means 24 in the form of a spiral spring all accommodated in the chamber 15c. The swivel disc 22 has an axial bore 22a through which it is rotatably supported on a support pin 25 secured to and extending vertically upwardly from the base 17. The swivel disc 22 has an annular opening 22b for accommodating the spiral spring 24 and a first anchoring cavity 22c formed in the inner peripheral wall of the disc 22 for anchoring one end of the spiral spring 24. The spiral spring 24 is wound around the support pin 25 with its opposite end anchored in a radial slit 25a formed in the support pin 25, thereby forming a spiral structure concentric with the annular opening 22b of the swivel disc 22. The swivel disc 22 is further provided in its inner wall with a second anchoring cavity 22d remote from the first anchoring cavity 22c for anchoring one end of the actuating rope 23. The actuating rope 23 in the form of a metallic or plastic wire has its opposite end anchored to the inner longitudinal wall 15a of the casing 15. To ensure firm anchoring of the actuating rope 23, there are provided ball-like retainers 26 at respective tip ends of the rope 23 as shown in FIG. 2, although other anchoring means may be suitably used. The actuating rope 23 is passed around an outer peripheral wall 22e of the swivel disc 22, extended linearly within the chamber 15c and passed around a guide block 27 and around a guide roller 28 disposed on a leading end of the tongue 14 forwardly of the projection 14a until its leading end is anchored in place at the inner longitudinal wall 15a.

With this construction, the buckle assembly 10 according to the first preferred embodiment of the invention is capable of automatically controlling the tension applied to the strap S during use thereof under repeated severe tensile force exerted as in skiing or other athletic activities by the action of the tension control means which allows increasing and decreasing the effective length of the strap S most comfortable to the wearer. As the strap S is pulled in either direction, the actuating rope 23 is pulled out together with the plug member 11, causing the swivel disc 22 to rotate clockwise against the tension of the spiral spring 24, in which instance the plug member 11 moves outwardly apart from the socket member 12 by a distance commensurate with the magnitude of tensile force applied to the strap S and so moves outwardly a maximum distance to a point (FIG. 5) at which the projection 14a comes into locked engagement with the limiter lug 20 on the base 17. When the tensile force on the strap S is reduced and released, the swivel disc 22 is caused by the return action of the spiral spring 24 to reverse its rotation counterclockwise thereby pulling the actuating rope 23 back together with the plug member 11 into the normal original position shown in FIG. 2. Thus, the plug member 11 is arranged with its tongue 14 to reciprocate through the guide slot 16 in the socket member 12 for a distance which may be determined by a chosen length of the tongue 14.

Referring now to FIGS. 6–9 inclusive, there is shown a modified form of buckle assembly 10' according to the invention which incorporates means of adjusting the compressive tension of the spiral spring 24 to suit any particular application of the strap S. A tension adjusting means 30 comprises a rotating member 31 in the form of a spline shaft and a stopper member 32. The rotating member 31 has a plurality of equally spaced radially extending splines 31a (presently shown to be four) and a circular cap 31b with a peripheral hook 31c. The rotating member 31 has its shaft portion 31d passed through a first opening 33 formed in the casing 15 and a second opening 34 formed in the base 17 in alignment with the first opening 33 and rotatably held by an annular retainer 35. The rotating member 31 serves to play the role of the supporting pin 25 (FIGS. 1 and 2) in relation to the spiral spring 24 and the swivel disc 22.

Figure 7:
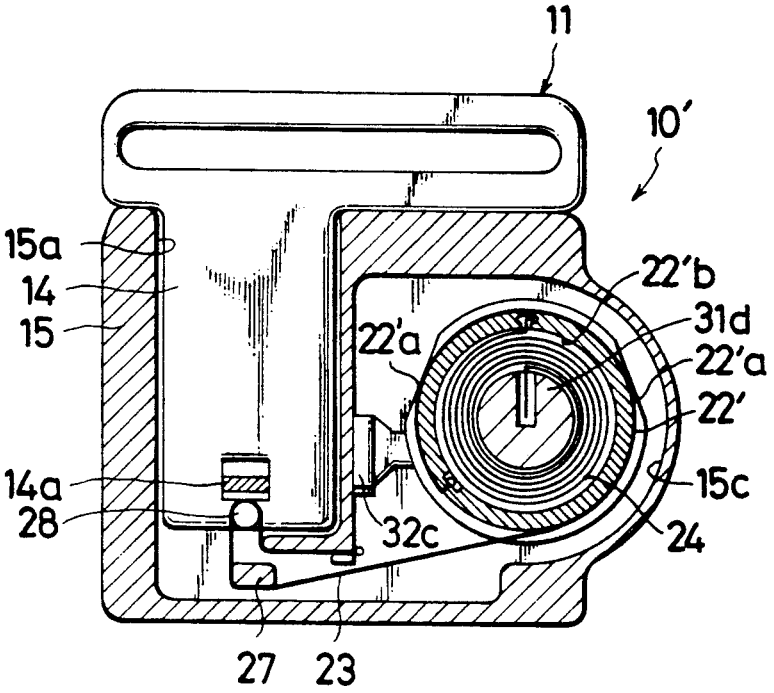
FIG. 7 is a partly sectional plan view of the buckle assembly shown in FIG. 6.
Figure 8:
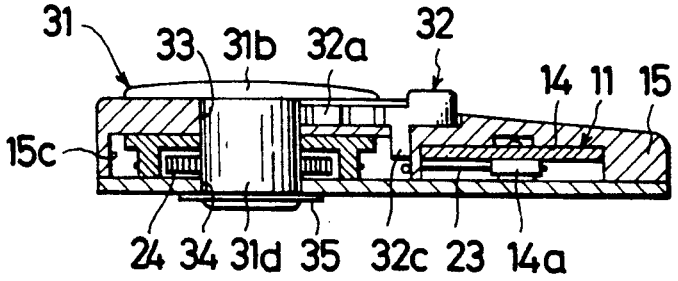
FIG. 8 is a transverse cross-sectional view taken on the line VIII—VIII of FIG. 6.
Figure 9:
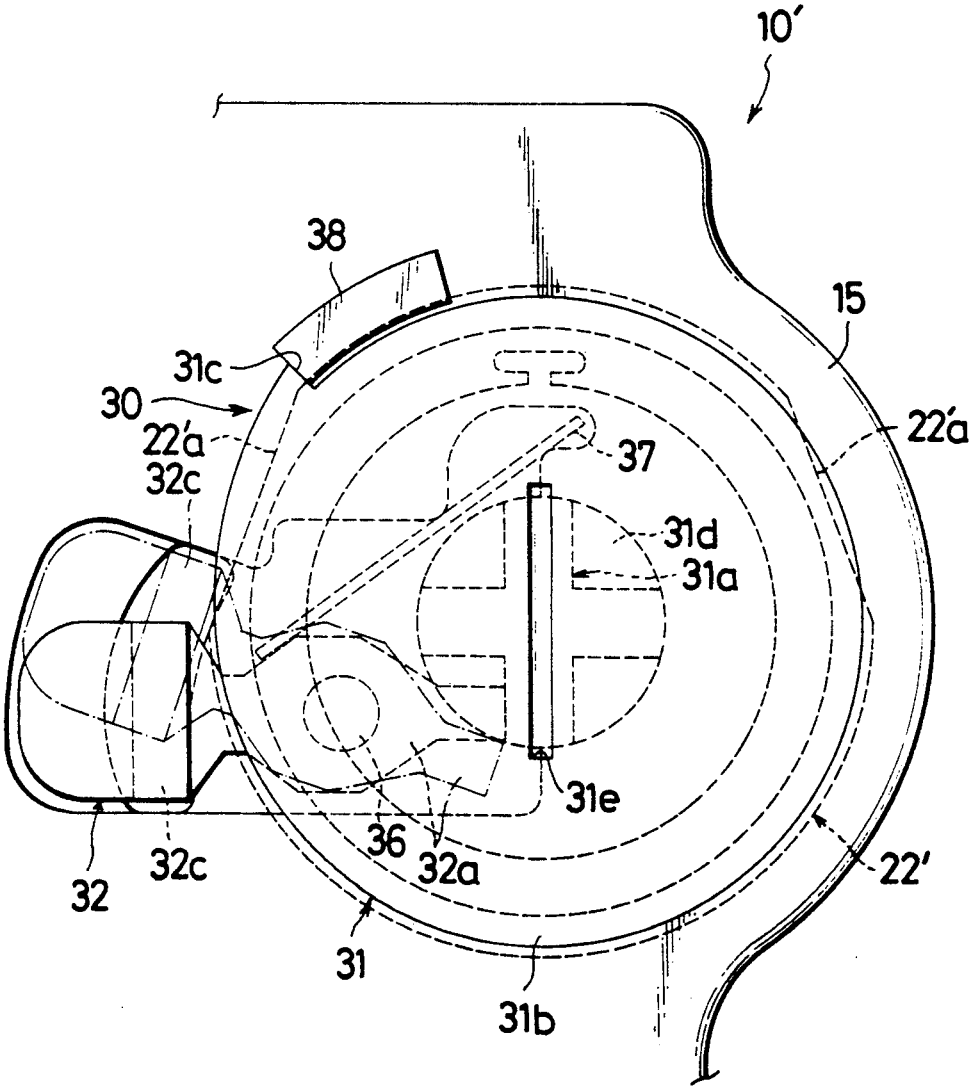
FIG. 9 a partly sectional plan view on enlarged scale of a the buckle assembly of FIG. 6.
Figure 10:
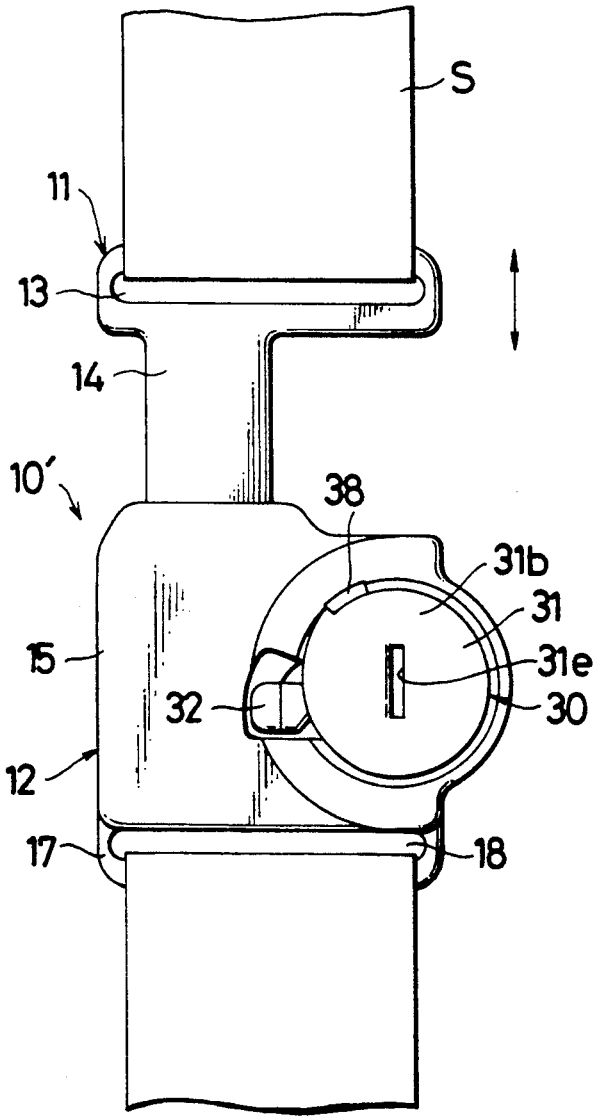
FIG. 10 is a plan view of the buckle assembly of FIG. 6 shown applied to a strap.

As better shown in FIG. 7, the spiral spring 24 has one of its ends connected to the shaft portion 31d of the rotating member 31 and the opposite end connected to a swivel disc 22' which has two diammetrically opposed flat peripheral guide surfaces 22'a.

The stopper member 32 includes a horizontally extending arm 32a having a prong 32b and a vertical leg 32c and is pivotally connected to a pin 36 disposed in the casing 15 of the socket member 12. A leaf spring 37 is adapted to normally bias the stopper member 32 toward the rotating member 31. The stopper member 32, when assembled, is disposed with its prong 32b engageable with one of the four splines 31a of the rotating member 31 and its leg 32c engageable with either of the flat guide surfaces 22'a of the swivel disc 22'. With the plug member 11 fully engaged with the socket member 12, the rotating member 31 is turned counterclockwise until the hook 31c comes into abutting engagement with a lug 38 formed on the upper surface of the casing 15, thereby setting up an initial tension of the spiral spring 24.

In use of the buckle assembly 10' thus constructed, the stopper member 32 is turned against the tension of the leaf spring 37 until its prong 32b is disengaged from one of the splines 31a of the rotating member 31, whereupon the leg 32c of the stopper member 32 comes into abutting engagement with either of the flat guide surfaces 22'a of the swivel disc 22' so that the swivel disc 22' is locked against reverse rotation. In this condition, a coin or other suitable insert (not shown) is inserted into a slit 31e formed in the upper surface of the circular cap 31b of the rotating member 31 and turned counterclockwise for an angular distance required to provide a desired increase stepwise in the tension of the spiral spring 24, whereupon the prong 32b of the stopper member 32 is brought into locking engagement with either one of the splines 31a of the rotating member 31. Thus, the tension upon the strap S can be adjusted at will to provide a comfortable fit with the body of the wearer.

Figure 11:
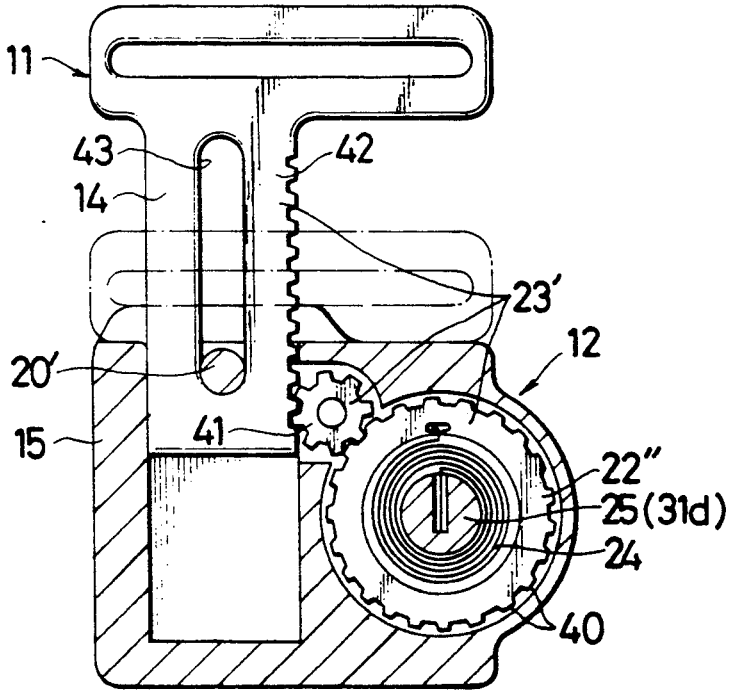
FIG. 11 is a partly sectional plan view of a buckle assembly incorporating a modified form of an operative member.

FIG. 11 shows a tension transmission means 23' in the form of a pinion-and-rack mechanism in lieu of the actuating rope 23 above described.

A swivel disc 22" is peripherally toothed as at 40 for meshing engagement with a pinion 41 rotatably supported in the socket member 12. The pinion 41 is in turn engaged with a rack 42 formed on one of the longitudinal edges of a tongue 14' of the plug member 11. A limiter lug 20' in the form of a pin secured to the socket member 12 is received in an elongate guide slot 43 which is formed in the tongue 14' of the plug member 11 and which defines a distance of reciprocating movement of the plug member 11 relative to the socket member 12 in response to the tension applied to the strap S.

Obviously, various modifications and variations of the present invention are possible in the light of the above teaching. It is therefore to be understood that within the scope of the appended claims the invention may be practiced otherwise than as specifically described.

What is claimed is:

1. A buckle assembly for connecting respective ends of straps, belts, suspenders and the like which comprises:

a plug member having an engaging tongue and an elongate opening for receiving one end of a strap;

a socket member engageable with said plug member and having an elongate opening for receiving the opposite end of said strap;

a tension control means accommodated in said socket member and comprising a swivel disc rotatably supported in said socket member, a tensioning means operatively connected to said swivel disc for normally biasing said plug member toward said socket member, and a tension transmission means connected between said plug member and said swivel disc and adapted to transmit tensile forces to and from said strap; and a tension adjusting means comprising a rotating member disposed coaxially with said swivel disc, connected to said tensioning means for adjusting the tension of the tensioning means, said tension adjusting means having a plurality of radially extending splines and a stopper member engageable with said splines to hold said rotating member against rotative movement.

2. A buckle assembly according to claim 1 wherein said tensioning means is a spiral spring connected at one of its ends to said socket member and at the opposite end to said swivel disc, and said tension transmission means is an actuating rope connected at one of its ends to said swivel disc and at the opposite end to a leading end of said tongue of said plug member.

3. A buckle assembly for connecting respective ends of straps, belts, suspenders and the like which comprises:

a plug member having an engaging tongue with a rack formed on one of the longitudinal edges thereof and an elongate opening for receiving one end of a strap;

a socket member engageable with said plug member and having an elongate opening for receiving the opposite end of said strap; and a tension control means accommodated in said socket member and comprising a swivel disc rotatably supported in said socket member and having peripheral teeth, a tensioning means operatively connected to said swivel disc for normally biasing said plug member toward said socket member and a pinion interposed between and for meshing engagement with said peripheral teeth of the swivel disc and said rack formed on the longitudinal edge of the tongue of the plug member.

4. A buckle assembly according to claim 3, wherein said tensioning means is a spiral spring connected at one of its ends to said socket member and at the opposite end to said swivel disc.

5. A buckle assembly according to claim 3 further including a tension adjusting means which comprises a rotating member disposed coaxially with said swivel disc, connected to said tensioning means for adjusting the tension of the tensioning means, said tension adjusting means having a plurality of radially extending splines and a stopper member engageable with said splines to hold said rotating member against rotative movement.

6. A buckle assembly for connecting ends of strap-like members comprising:

a plug member having an engaging tongue and a means for connecting an end of a strap-like member;

a socket member engageable with said plug member and having means for connecting an end of a strap-like member;

a tension control means mounted to said socket member providing a swivel disc rotatably supported in said socket member, a tensioning means connected to said swivel disc and said socket for normally rotationally biasing said swivel disc in a first rotational direction, and a tension transmission means connected between said plug member and said disc for coupling tensile forces to and from said plug member to rotational forces from and to said disc; and a tension adjusting means mounted to said socket member for selectively adjusting the rotational bias of the swivel disc.

7. A buckle assembly according to claim 6, wherein said tensioning means is a spiral spring connected at one of its ends to said swivel disc, and said tension adjusting means comprises a rotating member mounted coaxially within said swivel disc connected to said spiral spring at its opposite end, said rotating member having a plurality of radially extending splines, and said tension adjusting means also provides a stopper member mounted to said socket member and engageable with a selected one of said splines to hold said rotating member against rotative movement, and said tension transmission means is an actuating rope connected at a first end to said swivel disc and operatively connected at a distance therefrom to a leading end of said tongue of said plug member.

8. A buckle assembly according to claim 7, wherein said actuating rope is connected at a second end to said socket member and said leading end of said tongue provides a guide roller, said actuating rope looped around said guide roller between said first end and said second end of said actuating rope.

9. A buckle assembly according to claim 7, wherein said stopper member is pinned at a central portion thereof to said socket member, and said stopper member provides at a first end a prong for engaging said one of said splines and at a second end a leg; and said swivel disc provides at least one flat portion around its periphery, said stopper member selectively pivotable by a user to simultaneously disengage said prong from said one of said splines and engage said leg against said flat portion to allow said rotating member to be selectively rotated while said leg holds said swivel disc in fixed rotational position.

10. A buckle assembly for connecting two strap-like members comprising:

a plug member having an engaging tongue with a rack formed on one of the longitudinal edges thereof and a connection means for connecting an end of a strap-like member;

a socket ember engageable with said plug member and having a second connection means for connecting an end of a strap-like member; and a tension control means accommodated in said socket member having a swivel disc rotatably mounted to said socket member, said swivel disc having peripheral teeth, a tensioning means operatively connected to said swivel disc for normally rotationally biasing said swivel disc in a first rotational direction, and a pinion interposed between, and in meshing engagement with, said peripheral teeth of said swivel disc and said rack formed on the longitudinal edge of the tongue of the plug member.

11. A buckle assembly according to claim 10, further comprising a tension adjusting means mounted to said socket member for selectively adjusting the rotational bias of the swivel disc.

12. A buckle assembly according to claim 11, wherein said tensioning means is a spiral spring connected at one of its ends to said swivel disc, and said tension adjusting means comprises a rotating member mounted coaxially within said swivel disc connected to said spiral spring at its opposite end, said rotating member having a plurality of radially extending splines, and said tension adjusting means also provides a stopper member mounted to said socket member and engageable with a selected one of said splines to hold said rotating member against rotative movement.

13. A buckle assembly according to claim 12, wherein said stopper member is pinned at a central portion thereof to said socket member, and said stopper member provides at a first end a prong for engaging said one of said splines and at a second end a leg; and said swivel disc provides at least one flat portion around its periphery, said stopper member selectively pivotable by a user to simultaneously disengage said prong from said one of said splines and engage said leg against said flat portion to allow said rotating member to be selectively rotated while said leg holds said swivel disc in fixed rotational position.

* * * * *